US005554210A

United States Patent [19]

Anderson

[11] Patent Number: 5,554,210

[45] Date of Patent: Sep. 10, 1996

[54] SUSPENSION DEVICE AND A RAPPING MECHANISM FOR ELECTRODES IN AN ELECTROSTATIC PRECIPITATOR

[75] Inventor: Torben P. Anderson, Valby, Denmark

[73] Assignees: FLS Miljø A/S, Denmark; Compania Sevillana de Electricidad, Spain

[21] Appl. No.: 371,223

[22] Filed: Jan. 11, 1995

[30] Foreign Application Priority Data

Jan. 11, 1994 [DK] Denmark ..... 0045/94

[51] Int. Cl.[6] ..... B03C 3/76

[52] U.S. Cl. ..... 96/33; 96/93; 173/94

[58] Field of Search ..... 96/32–38, 89, 96/91–94; 173/94; 95/76

[56] References Cited

U.S. PATENT DOCUMENTS

| | | | |
|---|---|---|---|
| 2,040,378 | 5/1936 | Hedberg et al. | 96/33 |
| 2,595,204 | 4/1952 | Richardson | 96/32 |
| 3,165,388 | 1/1965 | Jaderbrandt | 96/34 |
| 3,844,742 | 10/1974 | Petersen | 96/35 |
| 3,892,545 | 7/1975 | Goransson | 96/35 |
| 4,183,735 | 1/1980 | Goland et al. | 96/34 |
| 4,671,808 | 6/1987 | Goransson | 96/38 |
| 5,051,119 | 9/1991 | Lind | 96/38 |
| 5,344,481 | 9/1994 | Pettersson | 96/33 |
| 5,366,540 | 11/1994 | Bojsen | 96/33 |

FOREIGN PATENT DOCUMENTS

| | | | |
|---|---|---|---|
| 1077/92 | 8/1992 | Denmark . | |
| 1076/92 | 8/1992 | Denmark . | |
| 787043 | 9/1935 | France . | |
| 1557123 | 5/1972 | Germany . | |
| 157851 | 12/1982 | Germany | 96/34 |
| 3539205 | 5/1986 | Germany . | |
| 342990 | 2/1972 | Sweden . | |
| 381409 | 12/1975 | Sweden . | |
| 432927 | 6/1974 | U.S.S.R. | 96/34 |
| 2138170 | 10/1984 | United Kingdom . | |

OTHER PUBLICATIONS

Duda, "Cement Data Handbook," pp. 596–598 (Bauverlag Gmbh., Wiesbaden and Berlin, 3rd ed. 1985).

*Primary Examiner*—Richard L. Chiesa
*Attorney, Agent, or Firm*—Brumbaugh, Graves, Donohue & Raymond

[57] ABSTRACT

A suspension device and a rapping mechanism for electrodes in a high voltage supplied electrostatic precipitator, wherein the suspension device has at least one horizontally arranged supporting element from which a number of electrodes are suspended, the supporting element being mounted inside a precipitator housing, and wherein the rapping mechanism is of the type which transmits a rapping influence to the uppermost ends of the electrodes. The electrodes are pivotably suspended, preferably eccentrically, and are stabilized in a substantially vertical position. The supporting element receives impact or vibrating influences supplied by an impact hammer or vibrator in the longitudinal direction of the element, while the electrodes are substantially free of play in this direction such the impact or vibrating influence on the element is imparted to the electrodes.

10 Claims, 3 Drawing Sheets

SUSPENSION DEVICE AND A RAPPING MECHANISM FOR ELECTRODES IN AN ELECTROSTATIC PRECIPITATOR

BACKGROUND OF THE INVENTION

The invention relates to a suspension device and a rapping mechanism for electrodes, preferably the collecting electrodes, in an electrostatic precipitator for cleaning the smoke gases from industrial plants, power supply plants and the like.

Due to the way in which such an electrostatic precipitator works, dust is deposited on its electrodes during operation and therefore they should be relieved of this dust which is effected by transmitting impact energy to the electrodes thus exposing them to intensive vibration whereby the deposited dust is released.

The impact energy required for rapping or vibrating the electrodes is usually produced by a number of hammers being lifted off their vertically suspended position by a rotating shaft which extends transversally across the precipitator width and subsequently being released so as to revert to their vertical position. For each hammer an impact rod or an impact beam is provided which is hit by the hammer when the latter reverts to its vertical position and from the impact rod/beam the supplied impact energy is then transmitted to a section of precipitator electrodes.

Rapping mechanisms of this type are known, e.g. from Duda: "Cement Data Book", 3rd edition, pp. 596–598 (Bauverlag GmbH —Wiesbaden und Berlin 1985) and patent disclosures Nos. U.S. Pat. No. 3,844,742 and GB 2,138,170.

Usually the collecting electrodes consist of vertically suspended narrow substantially rectangular plates which at their uppermost ends are fastened to a suspension arrangement in a precipitator housing. The collecting electrodes may be mounted in mutually parallel rows forming precipitator sections and rapping is preferably effected sectionwise by means of drop hammers and impact rods. The collecting electrodes may be fastened to the suspension device using e.g. bolts yielding a stiff connection. Alternatively an excentrical one-point suspension arrangement of the electrode may be employed. Such suspension arrangement is known e.g. from U.S. Pat. No. 5,051,119.

In electrostatic precipitators of the so-called European type drop hammers and impact rods are usually used which are connected to the lowermost ends of the collecting electrodes and thereby they present the disadvantage that the hammers and their supporting elements occupy comparatively much space at the end of and below the precipitator sections which, in turn, presupposes an increased length and height of the precipitator housing containing the sections.

In the so-called American-type electrostatic precipitators, the rapping of the electrodes is often effected from the top of the precipitator, the rapping mechanism then being mounted externally on top of the precipitator housing and the rapping being effected by means of vertically mounted impact rods which hit the electrode suspension arrangement vertically. In this case each impact rod is provided with slide sealings around the passage through the precipitator housing roof. Certain types of "American" precipitators may alternatively be provided with a vertically acting rapping mechanism mounted inside the precipitator housing which actuates the electrodes axially. Moreover, when American-type precipitators are used having the rapping mechanism mounted on top of the precipitator housing roof, the volume occupied by the aggregate precipitator in the relevant plant is substantially increased.

SUMMARY OF THE INVENTION

It is therefore the object of the present invention to provide a suspension device and a rapping mechanism for electrodes in an electrostatic precipitator which permit a reduction of the volume occupied compared to known structures and which moreover allow for a suitable transmission of the impact energy to the electrode.

This object is achieved by means of a suspension device and a rapping mechanism wherein the suspension device comprises at least one substantially horizontally arranged elongated supporting element from which a number of electrodes are suspended, said supporting element being connected to the inner of a housing, wherein the rapping mechanism is of the type which transmits an impact or vibrating influence to the individual electrode at its uppermost ends, the rapping mechanism being adapted to supply the impact or vibrating influence to the supporting element in the longitudinal direction of this, and wherein the individual electrode is provided with means for cooperating with the supporting element in such a way that the electrode is suspended pivotably about a horizontal axis on the supporting element and when influenced by a downward directed force, e.g. gravity, is free of play relative to the supporting element in the longitudinal direction of this.

Hereby a suspension device and a rapping mechanism are provided wherein it is no longer necessary to mount the rapping mechanism on the outside of the precipitator housing as it is customary, e.g. in case of American type precipitators, whereby the aggregate precipitator volume is reduced. Due to the suspension free of play the electrode(s) is/are unable to perform translation movement relative to the suspension element in the longitudinal direction of this and a proper transmission of the impact or vibration influence can take place from the suspension element.

In a preferred embodiment the individual electrode relative to its vertical center line is suspended excentrically from the support and means for stabilizing the electrode(s) with a substantially vertical axis are provided at the lowermost end of the electrode(s). This improves the possibility for controlling the position of the electrodes.

In a further preferred embodiment of the invention the means for stabilizing the electrode(s) with a substantially vertical axis is constituted of a rod element which supports the electrode(s) from the side relative to the vertical center line where the excentrical suspension means on the individual electrode is provided. Due to the pivotable suspension of the electrode(s) it is possible to supply a rapping influence to both the top and the bottom of the electrodes. This is particularly advantageous in connection with long electrodes which may be difficult to clean by supplying a rapping influence to the one end only.

The suspension means of the electrode comprises preferably an open area for receiving a part of the support element whereby this open area is wedge-shaped so that due to gravity influence on the electrode, the received part of the support element rests at two points of the electrode suspension means.

Particularly conveniently the uppermost end of each electrode may comprise a hook-shaped part thereby facilitating the mounting and dismounting of the electrodes. The hook-shaped part may preferably in a mounted state comprise a substantially vertical part and in connection to this an inclined part, and wherein the supporting element is provided with means to cooperate with this hook-shaped part in such a way that due to gravity influence the electrode is in contact with the supporting element at two in the longitudinal direction of the supporting element mutually distanced points. The vertical part allows for a better transmission of the vibrating or impact influence from the support to the electrode.

The supporting element is preferably suspended resiliently in its longitudinal direction and due to the resilient suspension arrangement of the supporting element in the longitudinal direction of the latter, a subtantially improved energy transmission to the electrodes is provided since substantially less energy is absorbed in the precipitator housing.

The supporting element may advantageously be suspended in carrier beams which serve as flexing springs thereby rendering the structure very simple.

The result of rapping/vibrating at both ends of the electrode(s) is substantially superior to rapping/vibrating at only one end. In addition to the advantages previously mentioned regarding a reduction of the volume occupied at the top of the precipitator housing and an improved energy transmission, the further advantage is obtained with this particularly convenient embodiment of the invention that the cleaning of the electrodes is further improved as the suspension device according to the invention allows for the combination of rapping at the uppermost end of the electrodes with rapping at the lowermost end of the electrodes.

BRIEF DESCRIPTION OF THE DRAWINGS

An embodiment of the invention will now be explained in further detail with reference to the drawings, wherein.

DETAILED DESCRIPTION OF THE PREFERRED EMBODIMENT

Figure 1:
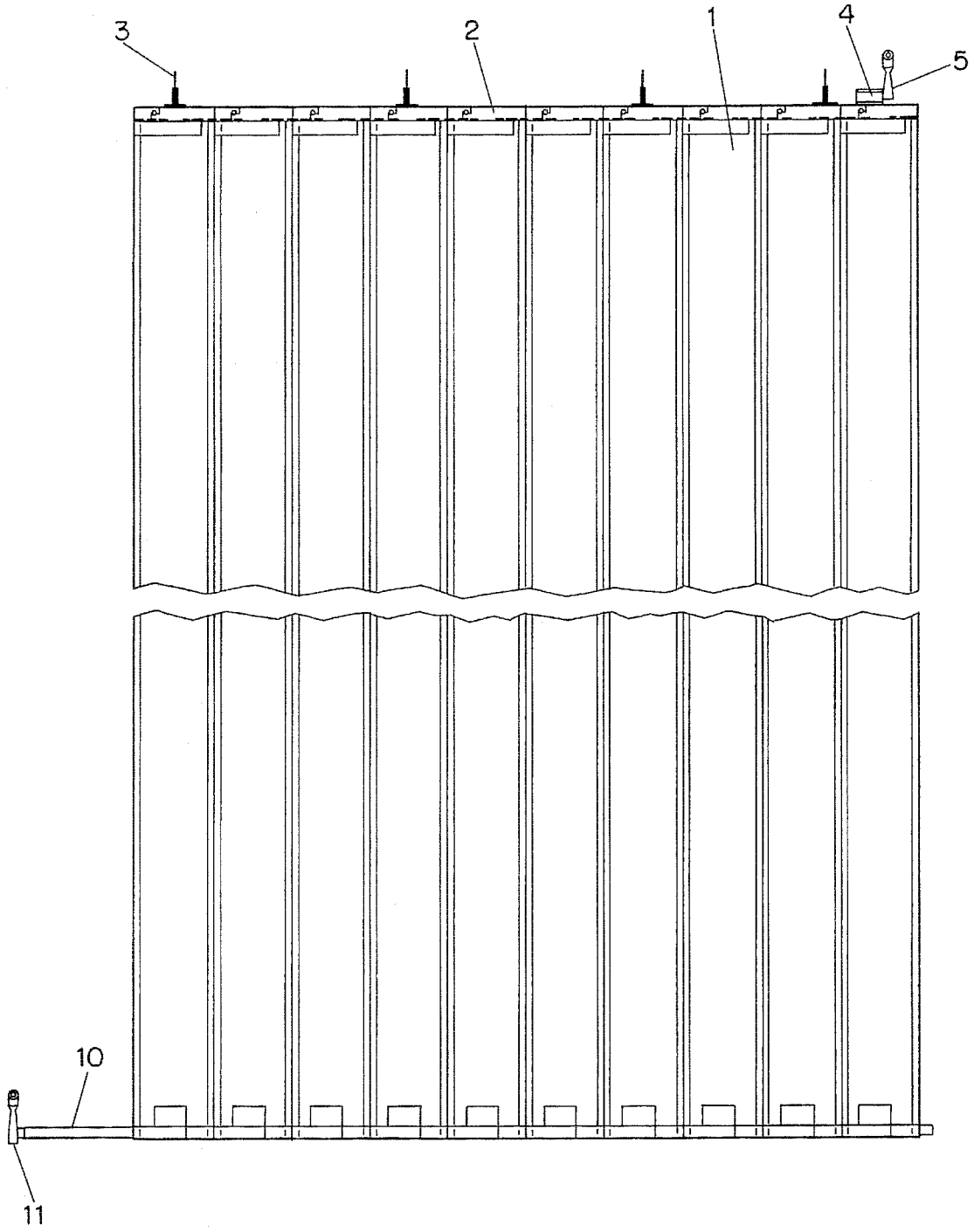
FIG. 1 shows a section of collecting electrodes suspended in a suspension device according to the invention.

FIG. 1 shows a section of plate-shaped collecting electrodes 1 which are suspended excentrically and pivotably in their own plane from a supporting element 2. The supporting element 2 is suspended in a not shown precipitator housing, e.g. in the roof thereof, by means of communication rods 3, which have the capacity to be resilient in the longitudinal direction of the supporting element 2. At the one end of the element 2 an anvil 4 is arranged for receiving impact influences from a hammer 5. At the bottom, the electrode section is provided with a rapping mechanism known per se where the impact rod constitutes a stabilizing device 10 for the electrodes and where a hammer 11 is provided at the end of the impact rod. The use of a lower impact system concurrently with an upper impact system is rendered possible by the excentrical suspension of the uppermost electrode ends and the free movement of the electrodes partly in the axial direction of the electrodes partly in the direction away from the stabilization device. Furthermore, the free movement of the electrodes in their axial direction means that the expansion of the electrodes in their axial direction will not cause the electrode to flex as would be the case with known systems where rapping is effected at the uppermost ends of the electrodes and where the lowermost ends of the electrodes are usually fastened.

Figure 2:
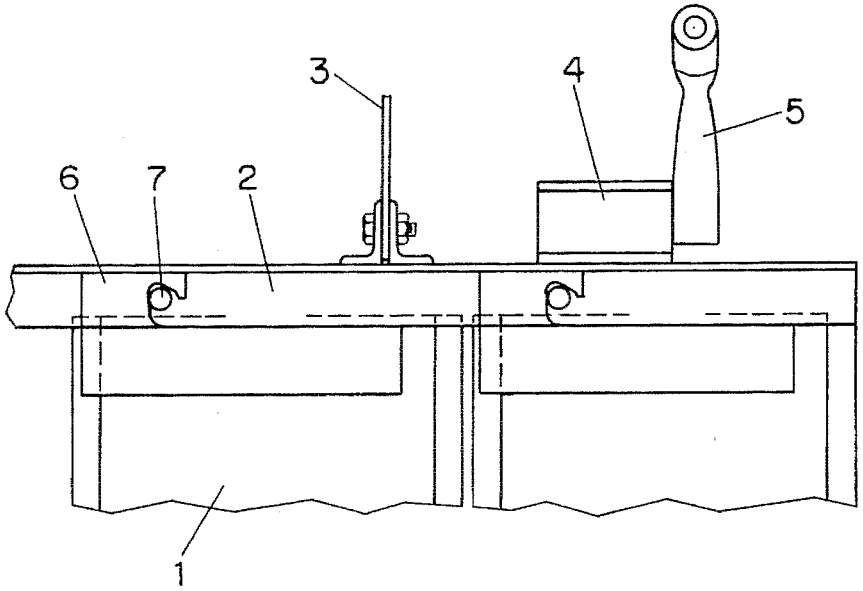
FIG. 2 is a more detailed view of a portion of the suspension device and a rapping mechanism connected thereto.

FIG. 2 shows more in detail how each plate electrode 1 is designed with a suspension hook 6 at its uppermost end. This hook 6 is caused to cooperate with carrier devices 7 on the supporting element 2. The fastening of the communication rod 3 on the element 2 will also appear clearly. When exposed to impact influence with the hammer 5 on the anvil 4, the communication rod 3 will move resiliently in the impact orientation.

Figure 5:
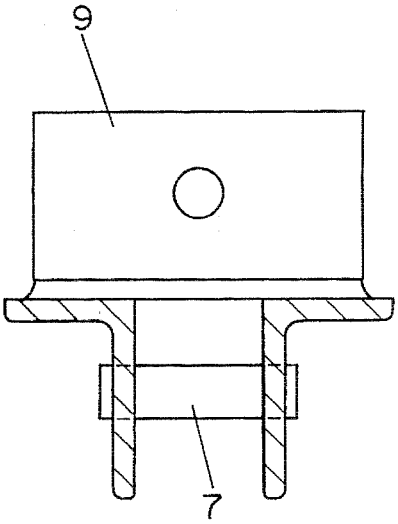
FIG. 5 is a sectional view of portions of the suspension device in its dismounted state.
Figure 6:
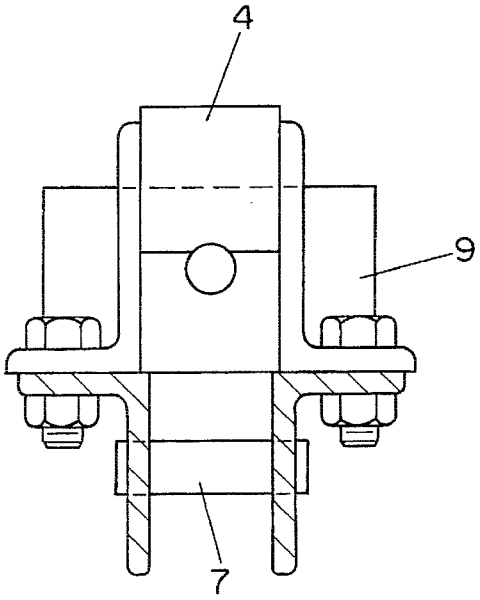
FIG. 6 is second sectional view of portions of the suspension device in its dismounted state.
Figure 3:
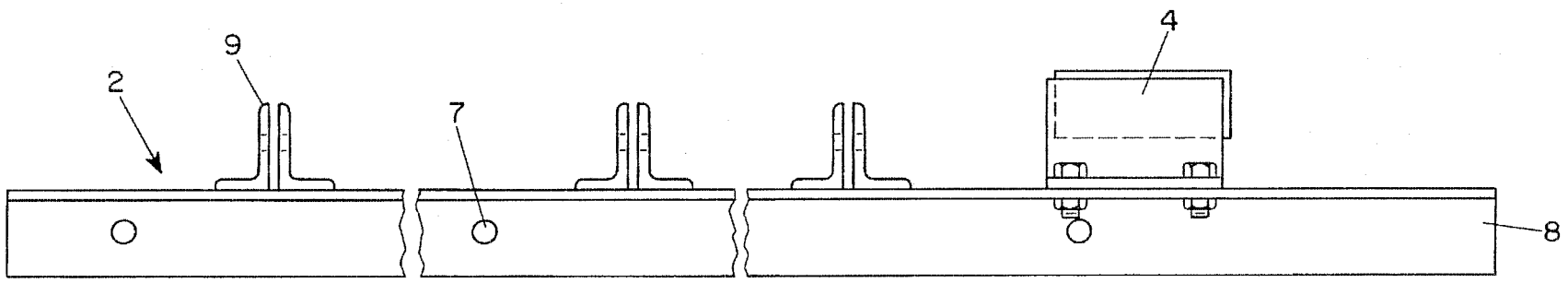
FIG. 3 is a side view of portions of the suspension device in its dismounted state.
Figure 4:
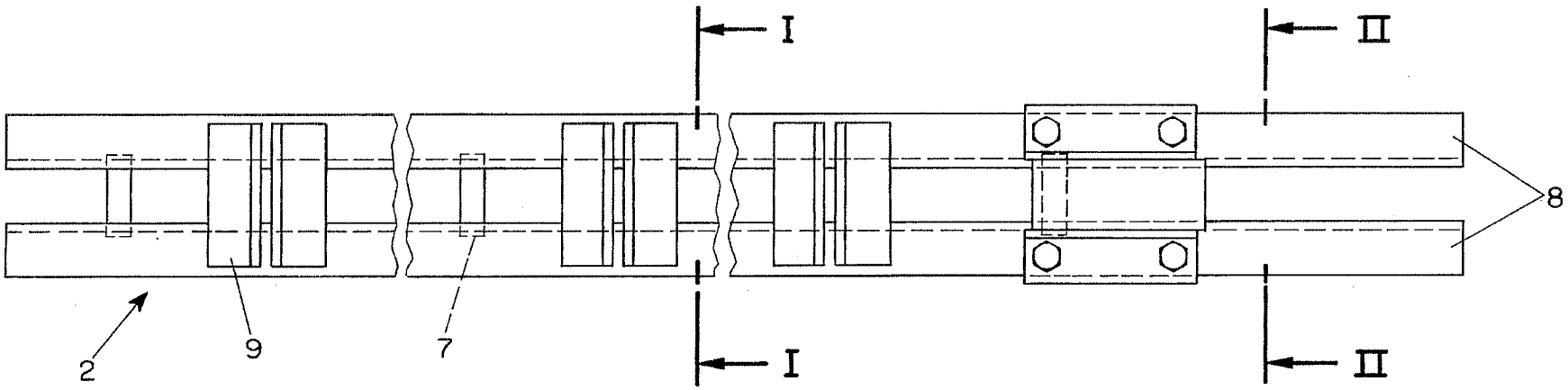
FIG. 4 is a top plane view of portions of the suspension device in its dismounted state.

FIG. 3 which is a side view of the supporting element 2, FIG. 4 which is a top plane view of the supporting element, and FIGS. 5 and 6 which are sectional views through the supporting element along the lines I—I and II—II, respectively, in FIG. 4 show how the supporting element may be designed by use of two angular elongated elements where carrier elements for the electrodes 1 are arranged between two opposite and mutually spaced surfaces and where additional transversal angular elements are welded onto the transversal and substantially parallel top surfaces, said angular elements serving as fastening points for the communication rods 3 in addition to forming the link between the two longitudinal angular elements. As depicted herein the anvil 4 is bolted onto the two longitudinal angular elements.

Although a drop hammer and an anvil has been described in connection with this embodiment, a vibrator could as well be used.

I claim:

1. A suspension device and a rapping mechanism for electrodes in an electrostatic precipitator for cleaning smoke gases, wherein the suspension device comprises at least one substantially horizontally arranged elongated supporting element from which a plurality of electrodes are suspended, said supporting element being connected to the inside of a precipitator housing, said rapping mechanism having means for transmitting an impact or vibrating influence to the individual electrode at least at its uppermost end, the rapping mechanism having means for supplying the impact or vibrating influence to the supporting element in the longitudinal direction of the element, and wherein the individual electrode is provided with suspension means for cooperating with the supporting element in such a way that the electrode is suspended pivotably about a horizontal axis on the supporting element and is free of play relative to the supporting element in the longitudinal direction of the element.

2. A suspension device and a rapping mechanism according to claim 1, wherein the individual electrode is suspended eccentrically relative to its vertical center line and wherein means for stabilizing the electrode with a substantially vertical axis is provided at the lowermost end of the electrode.

3. A suspension device and a rapping mechanism according to claim 2, wherein the means for stabilizing the electrode with a substantially vertical axis is comprised of a rod element which supports the electrode from that side relative to the mass center line where the eccentrical suspension means on the individual electrode is provided.

4. A suspension device and a rapping mechanism according to claim 3, wherein the rod element comprises means for receiving impact or vibrating influences in its longitudinal direction and wherein a means for supplying an impact or vibrating influence to the rod element is provided.

5. A suspension device and a rapping mechanism according to any one of claims 1–4 wherein the electrode comprises an open area for receiving a part of the supporting element whereby this open area is wedge-shaped so that due to gravity influence on the electrode, the received part of the supporting element rests at two points of the electrode suspension means.

6. A suspension device and a rapping mechanism according to claim 5, wherein the suspension means of the electrode is comprised of a hook-shaped part.

7. A suspension device and a rapping mechanism according to claim 6, wherein the hook-shaped part comprises in a mounted state a substantially vertical part and in connection to this an inclined part, and wherein the supporting element is provided with means to cooperate with this hook-shaped part in such a way that due to gravity influence the electrode is in contact with the supporting element at two mutually distinct points in the longitudinal direction of the supporting element.

8. A suspension device and a rapping mechanism according to any one of claims 1–4, wherein the supporting element is made of elongated elements which are mutually connected by shaft elements which cooperate said suspension means at the upper end of the individual electrode.

9. A suspension device and a rapping mechanism according to any one of claims 1–4, wherein the supporting element is suspended resiliently in its longitudinal direction.

10. A suspension device and a rapping mechanism according to any one of claims 1–4, wherein the supporting element is suspended resiliently by means of carrier beams acting as flexing springs.

* * * * *